US007905751B1

(12) United States Patent
Davis

(10) Patent No.: US 7,905,751 B1
(45) Date of Patent: Mar. 15, 2011

(54) ELECTRICAL CONNECTOR MODULE WITH CONTACTS OF A DIFFERENTIAL PAIR HELD IN SEPARATE CHICKLETS

(75) Inventor: Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/565,462

(22) Filed: Sep. 23, 2009

(51) Int. Cl.
*H01R 13/648* (2006.01)

(52) U.S. Cl. ..... 439/607.05

(58) Field of Classification Search ..... 439/607.41, 439/607.56, 607.39, 607.01, 607.05, 541.5
See application file for complete search history.

(56) References Cited

U.S. PATENT DOCUMENTS

| | | | | |
|---|---|---|---|---|
| 6,641,411 | B1 | 11/2003 | Stoddard et al. | |
| 6,905,367 | B2 * | 6/2005 | Crane et al. | 439/607.01 |
| 6,932,649 | B1 * | 8/2005 | Rothermel et al. | 439/620.01 |
| 7,097,506 | B2 * | 8/2006 | Nakada | 439/607.39 |
| 7,172,461 | B2 * | 2/2007 | Davis et al. | 439/607.11 |
| 7,331,802 | B2 | 2/2008 | Rothermel et al. | |
| 2003/0143894 | A1 * | 7/2003 | Kline et al. | 439/608 |
| 2009/0093158 | A1 * | 4/2009 | McAlonis et al. | 439/610 |

OTHER PUBLICATIONS

Molex, Backplane Connector System, © 2007, 6 pgs.

* cited by examiner

*Primary Examiner* — Chandrika Prasad

(57) ABSTRACT

An electrical connector includes a housing and contact modules held in the housing. Each of the contact modules has a first chicklet and a second chicklet coupled together to form a corresponding one of the contact modules. Contacts are held in the contact modules and arranged in differential pairs. A first contact in each of the differential pairs is held by the first chicklet and a second contact in each of the differential pairs is held by the second chicklet.

20 Claims, 10 Drawing Sheets

ELECTRICAL CONNECTOR MODULE WITH CONTACTS OF A DIFFERENTIAL PAIR HELD IN SEPARATE CHICKLETS

BACKGROUND OF THE INVENTION

The subject matter herein relates generally to electrical connectors, and more particularly, to high density electrical connectors.

Some electrical systems, such as network switches or computer servers with switching capabilities, include large backplanes with several daughter cards, such as switch cards or line cards, plugged into the backplane. The electrical systems utilize electrical connectors to interconnect the circuit boards defining the cards to the circuit board defining the backplane. Typically, the electrical connector is a right angle connector mounted to an edge of the backplane or one of the cards. The electrical connector is mated with a header connector mounted to a midplane.

Known electrical systems that utilize right angle connectors and header connectors mounted to a midplane are not without disadvantages. For instance, a large number of switch cards and line cards are typically connected to the backplane, which increases the overall size of the backplane. The density of the electrical connectors has an impact on the overall size of the electrical connectors, and thus the overall size of the backplane. The density may be expressed in terms of the number of signal contacts or pairs of signal contacts per linear inch of the electrical connector. While decreasing the spacing between the signal contacts is one way of increasing the density, decreasing the spacing may negatively affect the electrical performance of the electrical connector. The amount of undesirable coupling between adjacent signal contacts is based at least in part on the distance between the signal contacts. As such, merely changing the spacing between the signal contacts may not be an effective way to increase the density of the electrical connector, as the electrical connector may not perform adequately.

One method of reducing undesirable coupling and corresponding signal degradation between adjacent signals may be achieved by surrounding particular signal contacts or pairs of signal contacts with ground contacts. However, adding ground contacts reduces the overall density of the electrical connector by taking up space, thus increasing the spacing between the signal contacts or pairs of signal contacts.

Thus, providing a high density electrical connector with minimal signal loss remains a challenge.

BRIEF DESCRIPTION OF THE INVENTION

In one embodiment, an electrical connector is provided that includes a housing and contact modules held in the housing. Each of the contact modules has a first chicklet and a second chicklet coupled together to form a corresponding one of the contact modules. Contacts are held in the contact modules and arranged in differential pairs. A first contact in each of the differential pairs is held by the first chicklet and a second contact in each of the differential pairs is held by the second chicklet.

In another embodiment, an electrical connector is provided including contact modules each having a first chicklet and a second chicklet separate and distinct from one another. The first chicklet has a first body holding first contacts and the second chicklet has a second body holding second contacts. The first body and the second body are coupled together along a contact module plane. The first contacts and the second contacts being arranged in differential pairs with each of the first contacts being oriented on an opposite side of the contact module plane as a corresponding one of the second contacts to define the differential pair. The electrical connector also includes a housing holding the contact modules such that the contact module planes are parallel to one another.

In a further embodiment, an electrical connector is provided that includes a housing holding a plurality of contact modules. The contact modules each include a first chicklet having a first body holding first contacts and first ground contact fingers being electrically grounded. The contact modules each include a second chicklet having a second body holding second contacts and having second ground contact fingers being electrically grounded. The second chicklet is separate and distinct from the first chicklet, and the second chicklet is coupled to the first chicklet to form each contact module. The contact modules have the first and second contacts arranged in differential pairs with one of the contacts of each differential pair being one of the first contacts and the other of the contacts of each differential pair being one of the second contacts.

DETAILED DESCRIPTION OF THE INVENTION

Figure 1:
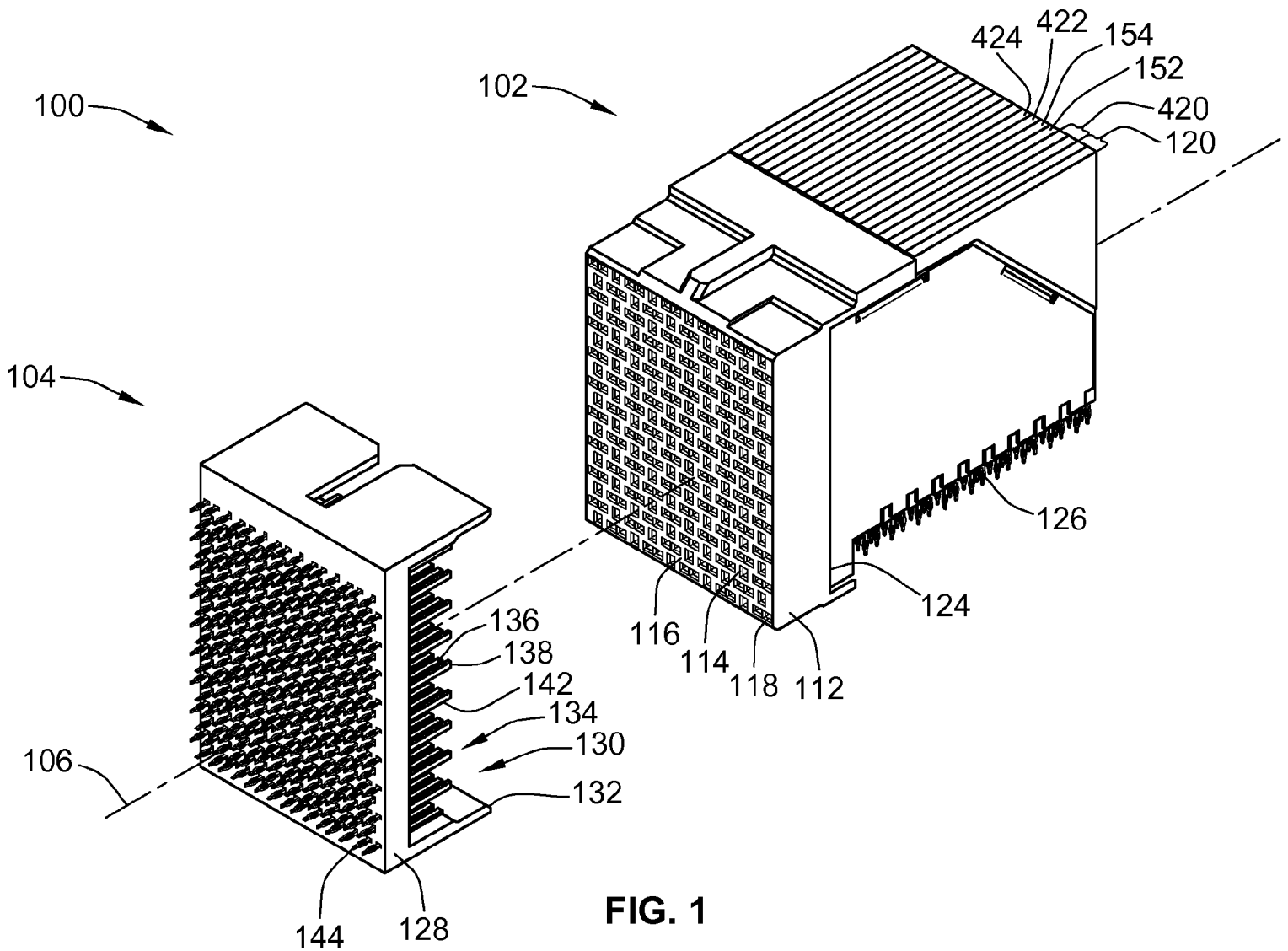
FIG. 1 is a perspective view of a connector system formed in accordance with an exemplary embodiment illustrating a receptacle connector and a header connector in unmated positions.

FIG. 1 is a perspective view of a connector system 100 formed in accordance with an exemplary embodiment illustrating two electrical connectors 102, 104 in an unmated position prior to mating with one another. The electrical connectors 102, 104 are each configured to be board mounted to circuit boards, such as backplanes, daughter cards, midplanes, or other circuit boards that are configured to be coupled together. The electrical connectors 102, 104 are utilized to electrically connect the circuit boards to one another. The electrical connectors 102, 104 may be cable mounted rather than board mounted in an alternative embodiment.

In the illustrated embodiment, the first electrical connector 102 constitutes a receptacle connector, and may be referred to hereinafter as receptacle connector 102. The second electrical connector 104 constitutes a header connector, and may be referred to hereinafter as header connector 104. The receptacle connector 102 is configured for mating with the header connector 104. A mating axis 106 extends through both the first and second electrical connectors 102, 104 and the first and second electrical connectors 102, 104 are mated with one another in a direction parallel to and along the mating axis 106.

It is realized that in alternative embodiments different types of electrical connectors may be utilized to electrically connect the circuit boards. The different types of electrical connectors may have different shapes, form factors, mating interfaces, contact arrangements, contact types and the like in alternative embodiments. The receptacle connector 102 and header connector 104 are merely illustrative of an exemplary embodiment of the connector system 100.

The receptacle connector 102 includes a housing 112 having a mating face 114 at a front 116 of the housing 112. The front 116 is perpendicular to the mating axis 106. The housing 112 includes a plurality of contact channels 118 open at the front 116. A plurality of contact modules 120 are held by the housing 112. The contact modules 120 have a plurality of first and second signal contacts 122, 123 (shown in FIG. 4) (only the tails of which are illustrated in FIG. 1) that extend into the contact channels 118. The contact modules 120 are loaded through a rear 124 of the housing 112 such that the contact modules 120 are arranged vertically within the housing 112. In the illustrated embodiment, the receptacle connector 102 includes two different types of contact modules 120, namely an A type and a B type (identified by the reference numeral 420) of contact module. The A and B types of contact modules 120 differ in their arrangement of signal and ground contacts, as will be described in further detail below.

The contact modules 120 are configured to be electrically connected to one of the circuit boards along a mounting face 126. The mating face 114 is oriented perpendicular with respect to the mounting face 126 and the mating axis 106. The mounting face 126, as well as the circuit board, are arranged horizontally. Different, non-horizontal orientations are possible in alternative embodiments.

The header connector 104 includes a housing 128 having a mating face 130 at a front 132 of the housing 128. The front 132 is perpendicular to the mating axis 106. The housing 128 includes a chamber 134 that receives at least a portion of the receptacle connector 102. An array of signal contacts 136 is arranged within the chamber 134 for mating with corresponding signal contacts 122, 123 of the receptacle connector 102. The signal contacts 136 are held by the housing 128 and extend along the mating axis 106 into the chamber 134. The signal contacts 136 are electrically connected to the corresponding circuit board. The signal contacts 136 are blade-type contacts having a generally rectangular cross-section. The housing 128 also holds a plurality of ground contacts 138. The ground contacts 138 are configured to mate with ground contacts 140 (shown in FIG. 4) of the receptacle connector 102.

The signal contacts 136 include mating portions 142 at one end thereof and mounting portions 144 at the opposite end thereof. In the illustrated embodiment, the mounting portions 144 are eye-of-the-needle type contacts, however other types are possible in alternative embodiments. The mounting portions 144 are configured to be mounted to the circuit board.

Figure 2:
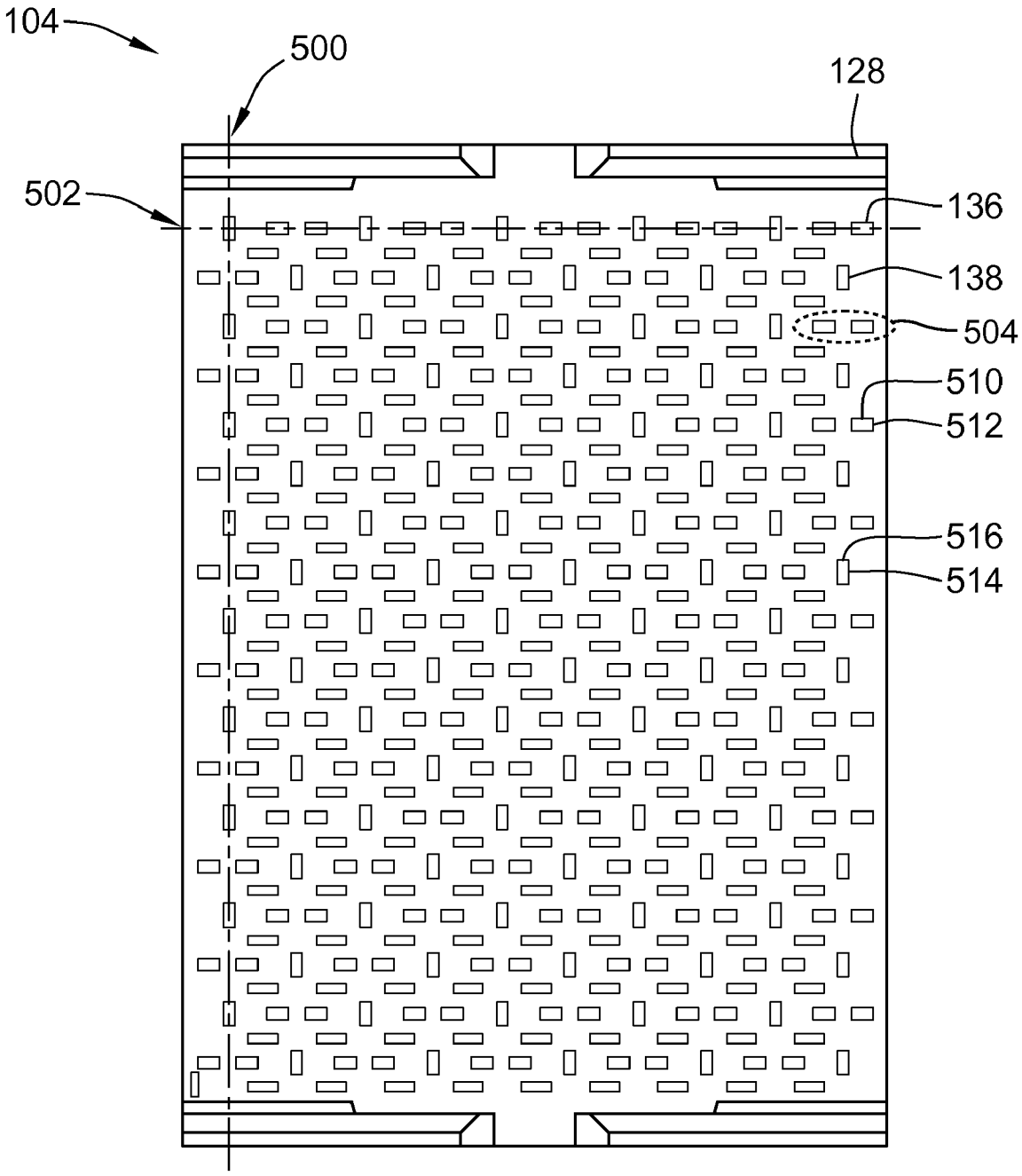
FIG. 2 is a front view of the header connector.

FIG. 2 is a front view of the header connector 104 illustrating the signal contacts 136 and the ground contacts 138. The signal contacts 136 and the ground contacts 138 are arranged in a matrix of columns 500 and rows 502. The signal contacts 136 are arranged in differential pairs 504, with adjacent differential pairs 504 being separated by ground contacts 138. The signal contacts 136 within each differential pair 504 are aligned with one another within the corresponding row 502. As a result, the overall density of the header connector 104 is increased as the number of signal contacts 136 provided over a given vertical height of the housing 128 is increased by aligning the signal contacts in a row 502, as compared to a situation in which the signal contacts 136 of each differential pair 504 are staggered vertically along the column 500.

Within each row 502, adjacent differential pairs 504 are separated by a ground contact 138. Similarly, within each column 500, adjacent differential pairs 504 are separated by a ground contact 138. The pattern of signal contacts 136 and ground contacts 138 in adjacent columns 500 alternates. For example, in the right-most column, the column 500 has a differential pair 504 of signal contacts 136 at the top-most position, followed by a ground contact 138 vertically below that. The pattern continues with alternating signal contacts 136 and ground contacts 138. In the second column from the right, the pattern is different, with a ground contact 138 at the top-most position, followed by a differential pair 504 of signal contacts 136.

In the illustrated embodiment, the signal contacts 136 and the ground contacts 138 are oriented differently. The signal contacts 136 include broadside surfaces 510 and edgeside surfaces 512 extending between the broadside surfaces 510. The edgeside surfaces 512 may be narrower than the broadside surfaces 510. The broadside surfaces 510 are oriented parallel to the rows 502 and the edgeside surfaces 512 are oriented parallel to the columns 500. Alternatively, the ground contacts 138 include broadside surfaces 514 and edgeside surfaces 516 extending between the broadside surfaces 514. The broadside surfaces 514 are oriented parallel to the columns 500 and the edgeside surfaces 516 are oriented parallel to the rows 502. In alternative embodiments, the signal contacts 136 and/or the ground contacts 138 may have an angular orientation with respect to the columns 500 and the rows 502. For example, the signal contacts 136 and/or the ground contacts 138 may be turned approximately 45° with respect to the columns 500 and the rows 502. Such an arrangement may affect the broadside and/or edgeside coupling between signal contacts 136.

Figure 3:
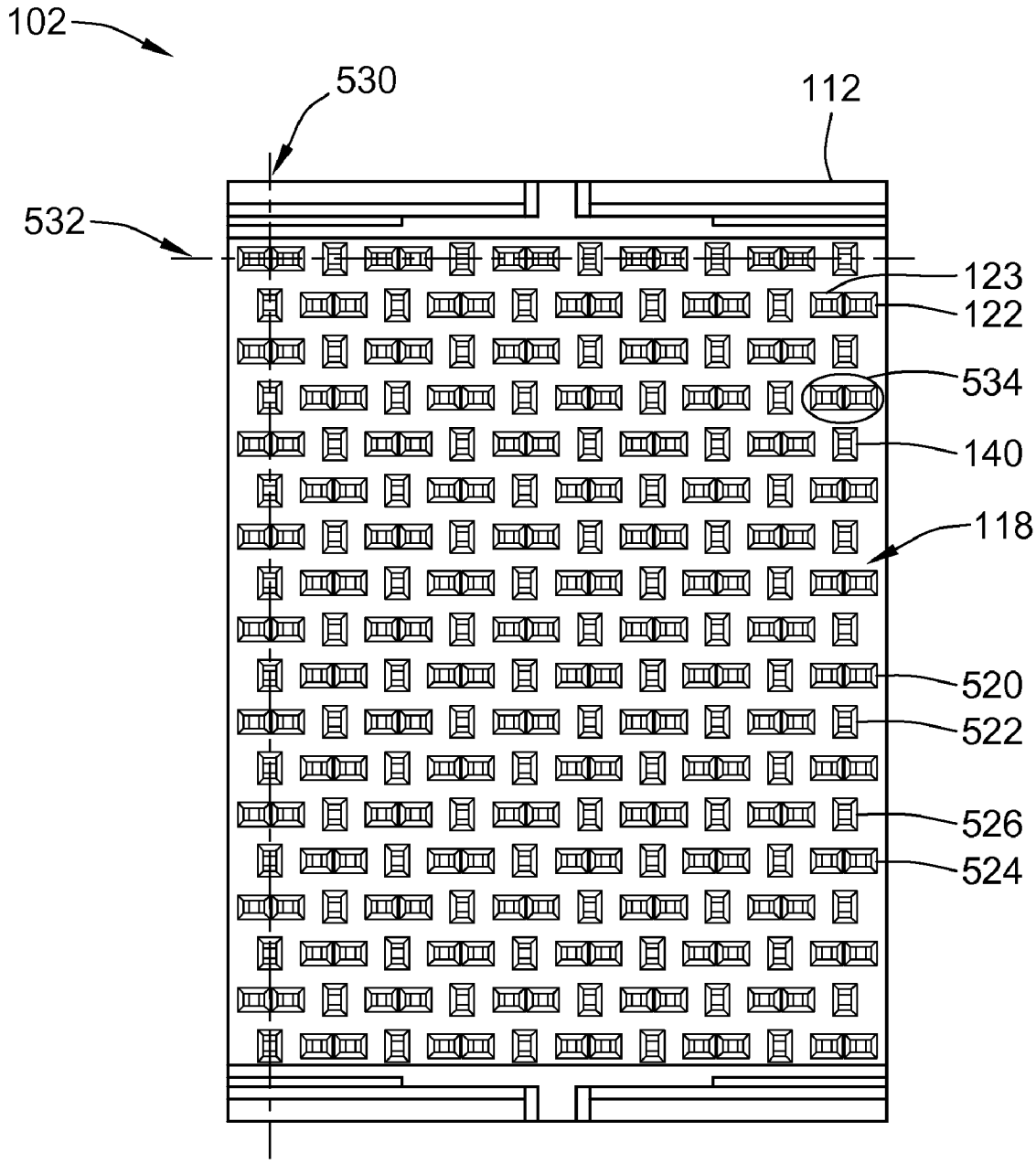
FIG. 3 is a front view of the receptacle connector.

FIG. 3 is a front view of the receptacle connector 102 illustrating mating portions of the signal contacts 122, 123 and the ground contacts 140. FIG. 3 also illustrates the housing 112 and contact channels 118. In an exemplary embodiment, the contact channels 118 include both signal contact channels 520 and ground contact channels 522.

The signal contact channels 520 are configured to receive the signal contacts 122, 123 as well as the signal contacts 136 (shown in FIGS. 1 and 2) of the header connector 104. The signal contact channels 520 are arranged in a pattern that complements the pattern of signal contacts 122, 123, 136. The signal contact channels 520 are defined by channel walls 524. In the illustrated embodiment, the channel walls 524 define signal contact channels 520 that have a rectangular cross-section.

The ground contact channels 522 are configured to receive the ground contacts 140 as well as the ground contacts 138 (shown in FIGS. 1 and 2) of the header connector 104. The ground contact channels 522 are arranged in a pattern that complements the pattern of ground contacts 138, 140. The ground contact channels 522 are defined by channel walls 526. In the illustrated embodiment, the channel walls 526 define ground contact channels 522 that have a rectangular cross-section.

The signal contacts 122, 123 and the ground contacts 142 are received in corresponding contact channels 520, 522. The signal contacts 122, 123 and the ground contacts 140 are arranged in a matrix of columns 530 and rows 532. The first and second signal contacts 122, 123 are arranged in differential pairs 534, with adjacent differential pairs 534 being separated by ground contacts 140. The signal contacts 122, 123 within each differential pair 534 are aligned with one another within one of the rows 532. As a result, the overall density of the receptacle connector 102 is increased as the number of signal contacts 122, 123 provided over a given vertical height of the housing 112 is increased by aligning the signal contacts 122, 123 of a differential pair in the same row 532, as compared to a situation in which the signal contacts of a differential pair are staggered vertically along a column.

Within each row 532, adjacent differential pairs 534 are separated by a ground contact 140. Similarly, within each column 530, adjacent differential pairs 534 are separated by a ground contact 140. The pattern of signal contacts 122, 123 and ground contacts 140 in adjacent columns 530 alternates. In the illustrated embodiment, the signal contacts 122, 123 and ground contacts 140 are generally aligned with one another along the contact module column 530. However, because the signal contacts 122, 123 are staggered with respect to the central plane of the contact module 120, it may be understood that the first contacts 122 are aligned in a first column and the second contacts 123 are aligned in a second column that is parallel to the first column.

Figure 4:
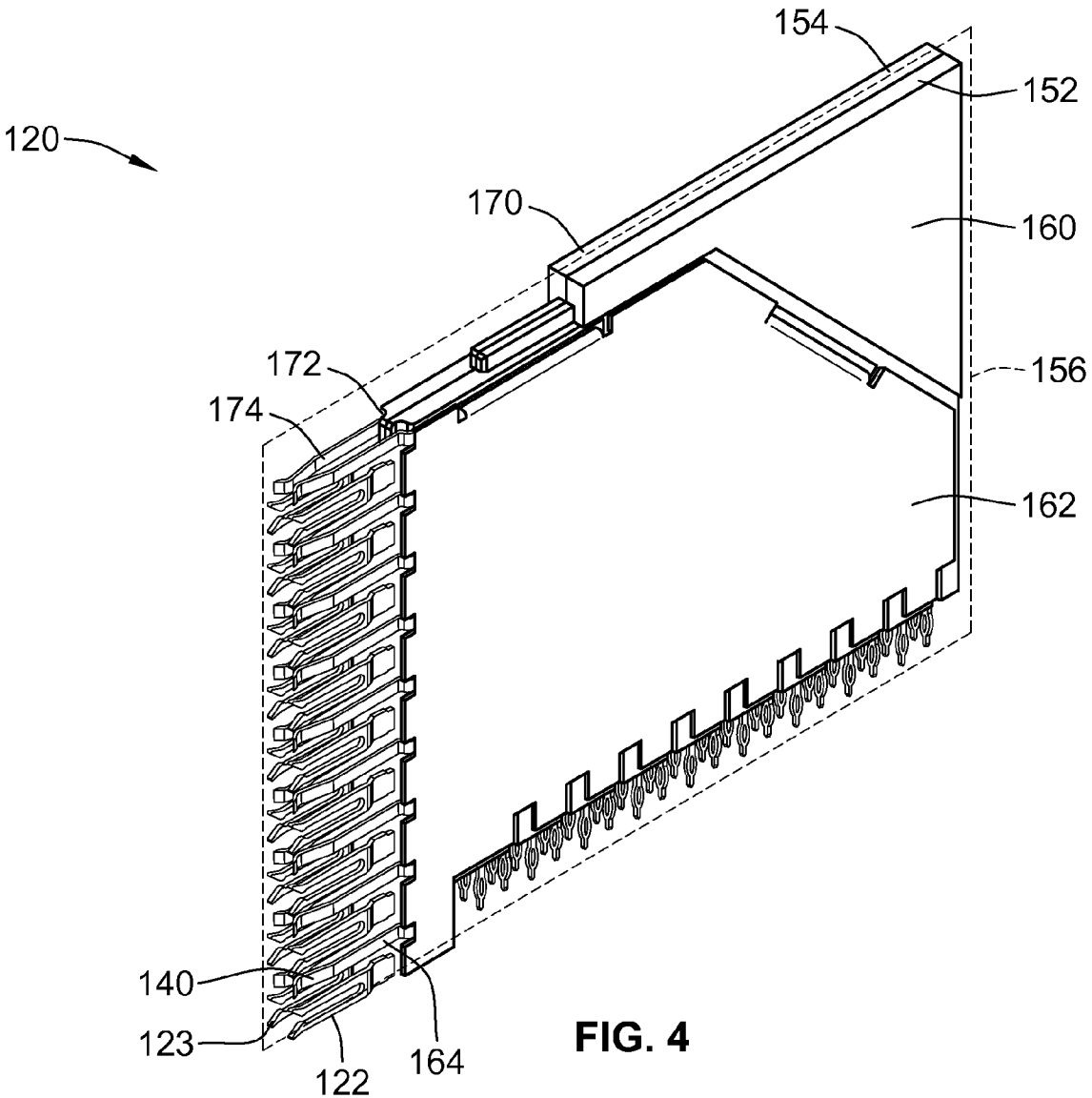
FIG. 4 is a front perspective view a contact module for the receptacle connector shown in FIG. 1.

FIG. 4 is a front perspective view a contact module 120 for the receptacle connector 102 (shown in FIG. 1). The contact module 120 includes a first chicklet 152 and a second chicklet 154. The first and second chicklets 152, 154 are separate and distinct from one another. The first and second chicklets 152, 154 are coupled together along a contact module plane 156 to form the contact module 120. The contact module plane 156 may be centered along the contact module 120. Optionally, the first and second chicklets 152, 154 are generally mirrored halves that are coupled together to form the contact module 120, but that include complementary mating features that hold the mirrored halves together. Once the first and second chicklets 152, 154 are coupled together, the contact module 120 may be loaded into the housing 112 (shown in FIG. 1).

The first chicklet 152 includes a body 160 that holds the first signal contacts 122. A first ground shield 162 is coupled to the body 160. The ground shield 162 includes first ground contact fingers 164 extending forward from the ground shield 162.

The second chicklet 154 includes a body 170 that holds the second signal contacts 123. A second ground shield 172 is coupled to the body 170. The ground shield 172 includes second ground contact fingers 174 extending forward from the ground shield 172.

When assembled, the signal contacts 122, 123 of both the first and second chicklets 152, 154 are aligned with one another on opposite sides of the contact module plane 156. The signal contacts 122, 123 are arranged in differential pairs 534, with the first signal contact 122 of the differential pair 534 being held by the first chicklet 152 on one side of the contact module plane 156 and the second signal contact 123 of the differential pair 534 being held by the second chicklet 154 on the opposite side of the contact module plane 156. When assembled, the ground contact fingers 164, 174 are aligned with one another on opposite sides of the contact module plane 156 and form a ground contact set. Each ground contact set of ground contact fingers 164, 174 defines one of the ground contacts 140. Each ground contact 140 includes two beams that engage opposite sides of the ground contact 138 (shown in FIG. 2) when the ground contact 138 is loaded therebetween. The two beams are comprised of the two ground contact fingers 164, 174, which represent spring fingers that engage opposite sides of the corresponding ground contact 138. Optionally, the ground fingers 164, 174 may have different lengths to sequence the mating of the ground contact set with the corresponding ground contact 138. As such, the mating forces may be reduced and/or the stub effect may be reduced. The ground shields 162, 172 may be electrically commoned via the ground contact 138 disposed between, and directly engaged by, the ground contact fingers 164, 174.

Figure 5:
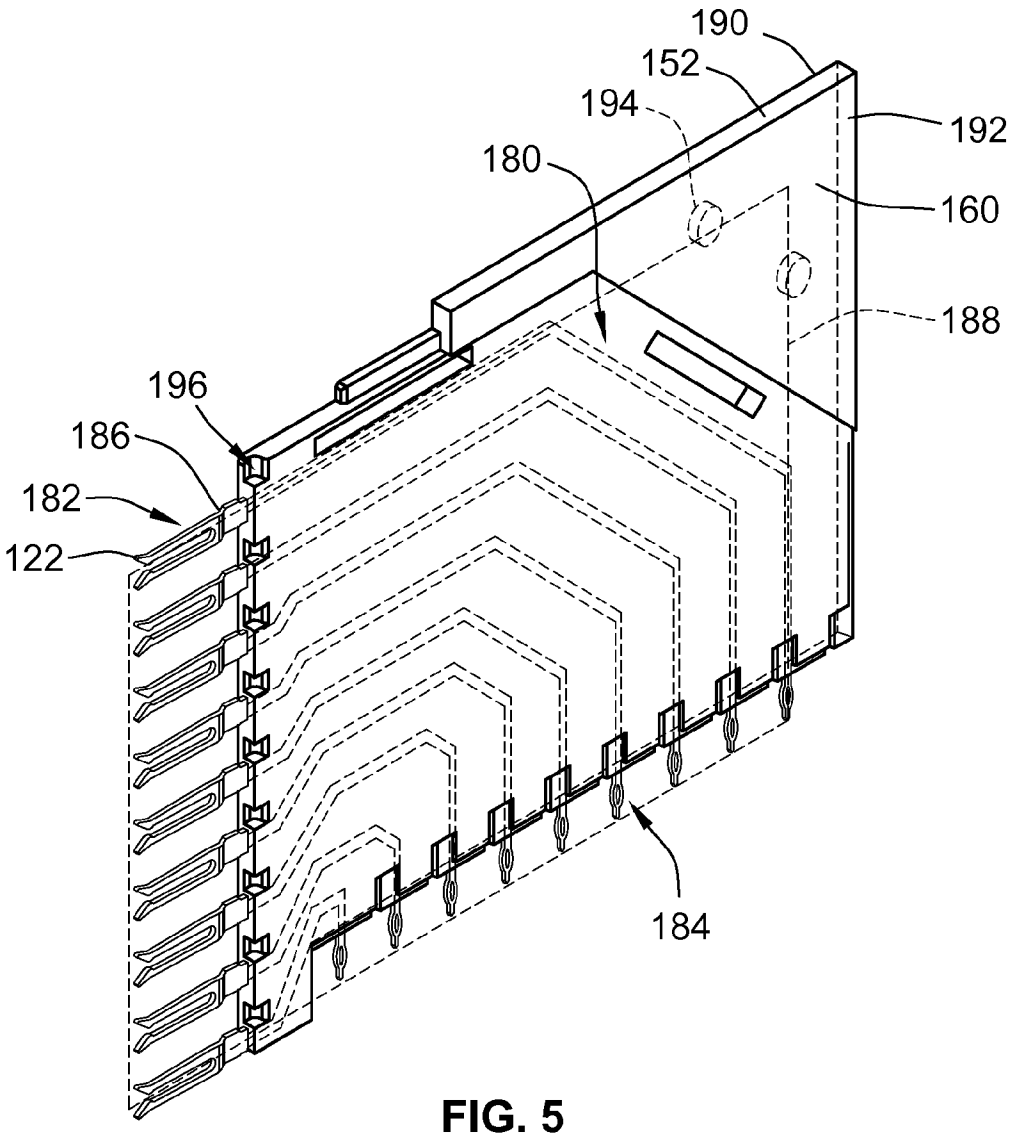
FIG. 5 is a front perspective view of a first chicklet forming part of the contact module shown in FIG. 4.

FIG. 5 is a front perspective view of the first chicklet 152 forming part of the contact module 120 (shown in FIG. 4). In an exemplary embodiment, the first chicklet 152 is formed with an overmolded lead frame type of structure, however the first chicklet 152 is not limited to such structure. The body 160 is formed by the dielectric material of the overmold, which encases a lead frame 180.

The lead frame 180 includes a plurality of stamped and formed metal conductors initially held together by a frame or carrier (not shown) that is ultimately removed. The metal conductors define the signal contacts 122. The signal contacts 122 are configured to carry data signals. In alternative embodiments, other types of contacts may be provided in addition to, or in the alternative to, the signal contacts 122, such as ground contacts, power contacts, and the like. In the illustrated embodiment, the signal contacts 122 of the first chicklet 152 are not arranged to carry differential pair signals with other signal contacts 122 of the first chicklet 152, but rather are configured to carry data signals that are independent from one another. However, the first signal contacts 122 cooperate with corresponding second signal contacts 123 of the second chicklet 154 (shown in FIG. 4) to carry differential pair signals with such corresponding second signal contacts 123. Hence, the signal contacts 122 in the first chicklet 152 that are arranged adjacent one another and in a common vertical column are associated with different differential pairs.

The signal contacts 122 have a mating portion 182 and a mounting portion 184 that are both exposed beyond edges of the body 160. In the illustrated embodiment, the mounting portion 184 constitutes an eye of the needle type contact that is configured to be received within a via of the circuit board. The mating portion 182 extends forwardly from a front end of the body 160. In the illustrated embodiment, the mating portion 182 constitutes a tuning fork style of contact that is configured to receive and mate with the blade type of signal contact 136 (shown in FIG. 1). Other types of contacts may be used in alternative embodiments for mating with the blade type of signal contact 136 or other types of signal contacts. In an exemplary embodiment, the mating portion 182 includes a jogged section 186 that transitions the mating portion 182 out of plane with respect to other portions of the signal contact 122.

The signal contacts 122 transition between the mating and mounting portions 182, 184 within the body 160. In an exemplary embodiment, the first chicklet 152 is a right angle chicklet with the mating portion 182 being oriented generally perpendicular with respect to the mounting portion 184. The signal contacts 122 are generally coplanar with one another along a lead frame plane 188. The lead frame plane 188 may be substantially centered within the body 160. The jogged section 186 may transition the mating portion 182 out of the lead frame plane 188.

The body 160 has opposed inner and outer sides 190, 192. The inner and outer sides 190, 192 are generally parallel to the lead frame plane 188. The signal contacts 122 may be generally centered between the inner and outer sides 190, 192. Optionally, the inner side 190 may be planar. The outer side 192 may include a recess that receives the first ground shield 162 (shown in FIG. 4). In an exemplary embodiment, the body 160 includes securing features 194 for securing the first chicklet 152 together with second chicklet 154 (shown in FIG. 4). In the illustrated embodiment, the securing features 194 are represented by pegs that extend inwardly from the inner side 190, and may be referred to hereinafter as pegs 194. The pegs 194 may be cylindrical in shape or have other shapes. Other types of securing features may be used in alternative embodiments, such as an opening, a fastener, a latch, an adhesive, and the like. Any number of securing features 194 may be used. More than one type of securing features 194 may be provided. In an exemplary embodiment, the body 160 includes grooves 196 at the corner of the front edge and outer side 192 that are configured to receive portions of the first ground shield 162.

Figure 6:
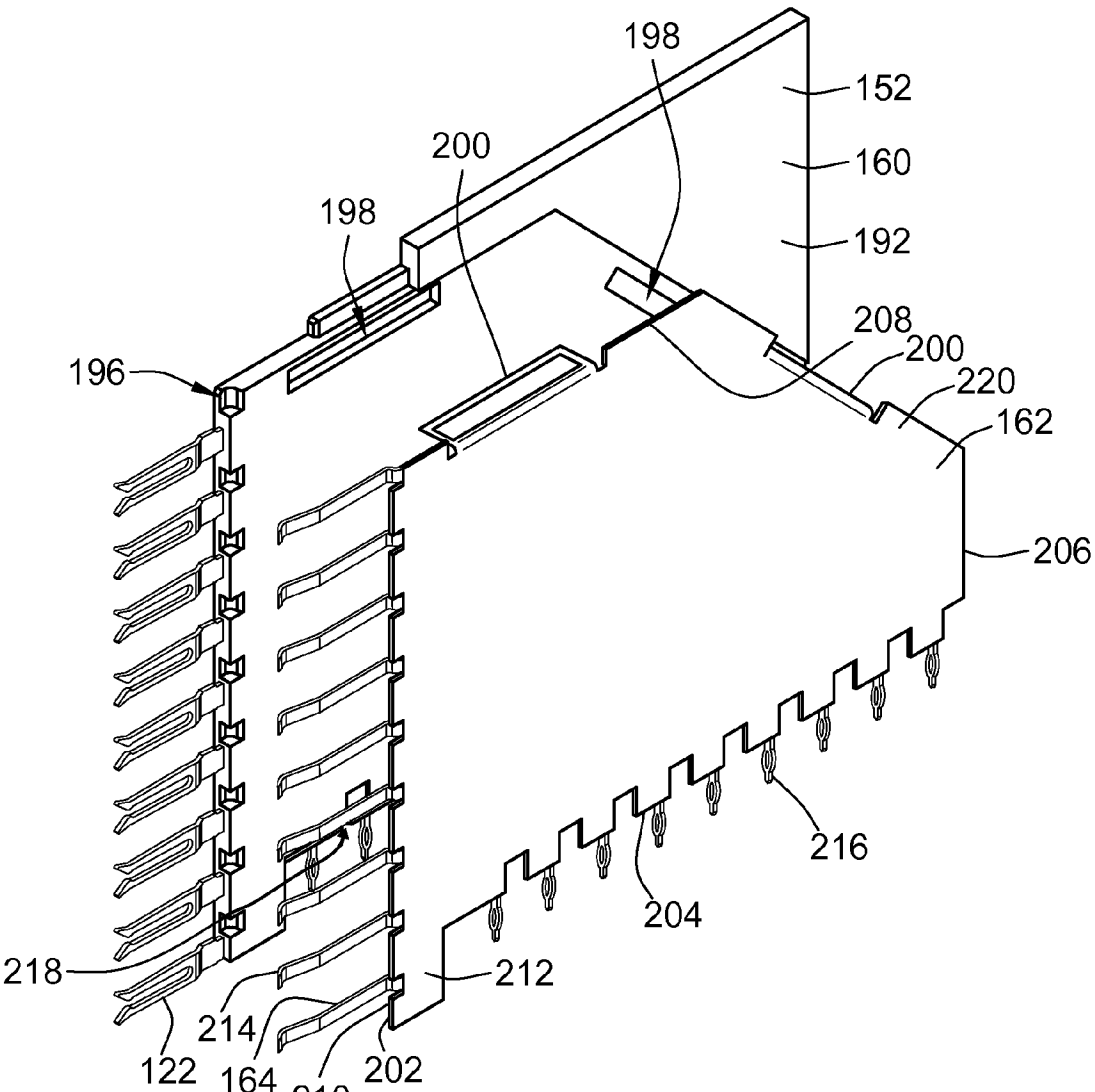
FIG. 6 illustrates a ground shield being coupled to the first chicklet shown in FIG. 5.

FIG. 6 illustrates the first ground shield 162 being coupled to the first chicklet 152. The first ground shield 162 is coupled to the outer side 192 of the body 160. The body 160 includes slots 198. The ground shield 162 includes first grounding tabs 200 extending inward therefrom. The first grounding tabs 200 are configured to be received in the slots 198.

The first ground shield 162 includes a forward mating edge 202 and a bottom mounting edge 204 that is perpendicular to the mating edge 202. The ground shield 162 also includes a rear edge 206 opposite the mating edge 202 and a top edge 208 opposite the mounting edge 204. The ground shield 162 has an inner side 210 and an outer side 212. When mounted to the contact module 120, the inner side 210 generally faces the body 160 and the outer side 212 generally faces away from the body 160.

In an exemplary embodiment, the ground shield 162 includes the first ground contact fingers 164 that extend forward from the mating edge 202. The first ground contact fingers 164 may extend inward from the inner side 210. The first ground contact fingers 164 are arranged along the mating edge 202 in a predetermined pattern. The first ground contact fingers 164 are aligned with the grooves 196. The first ground contact fingers 164 represent spring fingers that are deflectable. A mating interface 214 is provided proximate to a distal end of the first ground contact fingers 164. The mating interface 214 is configured for mating with the ground contact 138 (shown in FIG. 1).

The ground shield 162 includes shield tails 216 that extend downward and inward from the mounting edge 204. The shield tails 216 may include one or more eye-of-the-needle type contacts that fit into vias in the circuit board. Other types of contacts may be used for through hole mounting or surface mounting to the circuit board. The bulk of each shield tail 216 is positioned inward with respect to the ground shield 162, which is generally towards the contact module 120 when the ground shield 162 is coupled to the contact module 120. The shield tails 216 are configured to fit in slots 218 formed in the body 160. The shield tails 216 may be stamped from a ground plate 220 defining the ground shield 162 and then bent inward with respect to the ground plate 220. The shield tails 216 are electrically commoned with one another by the ground plate 220. Similarly, the first ground contact fingers 164 are electrically commoned with one another by the ground plate 220.

Figure 7:
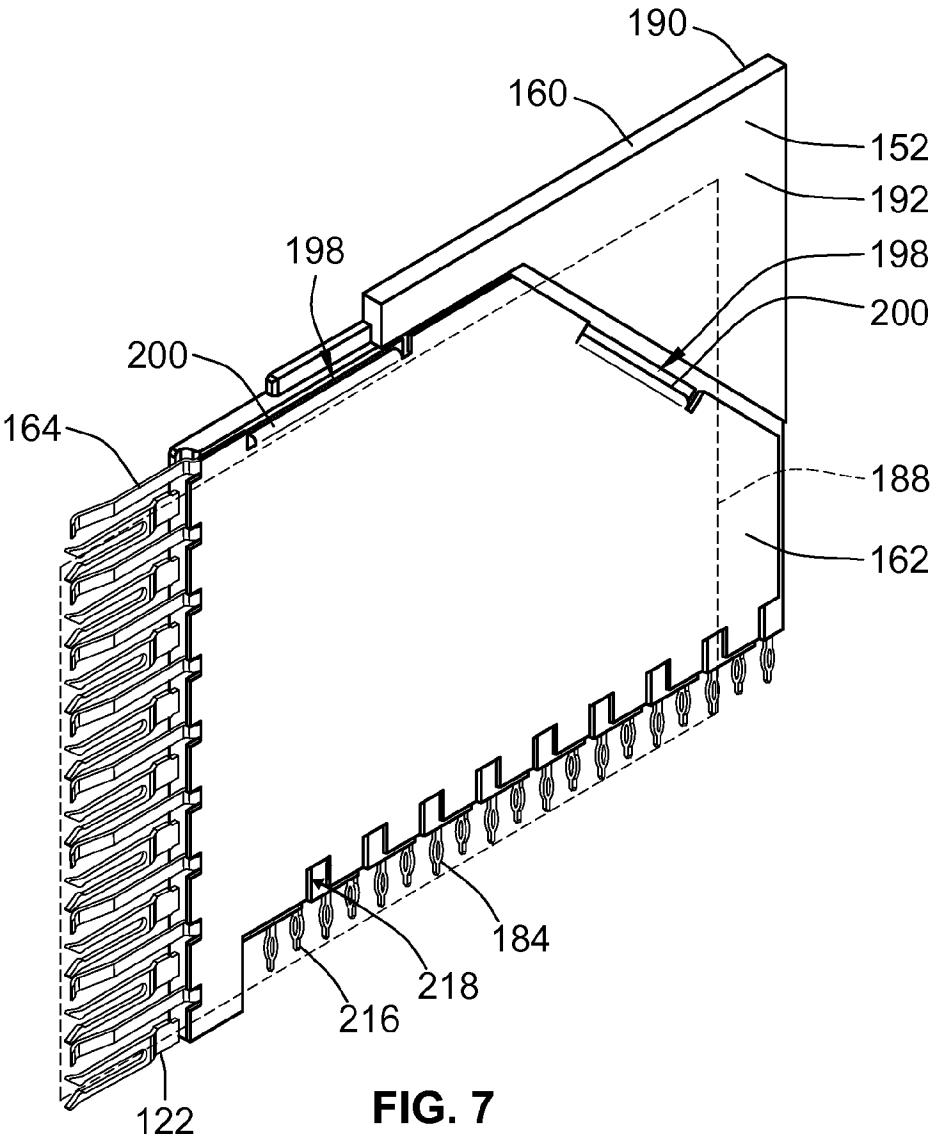
FIG. 7 illustrates the ground shield coupled to the first chicklet.

FIG. 7 illustrates the ground shield 162 coupled to the first chicklet 152. When assembled, the ground shield 162 is coupled to the outer side 192 of the body 160. The first grounding tabs 200 are received in the slots 198. Optionally, the first grounding tabs 202 may extend beyond the inner side 190 such that the first grounding tabs 202 engage the second chicklet 154 (shown in FIG. 4).

The first ground contact fingers 164 extend forward of the ground shield 162 and the body 160. The first ground contact fingers 164 may be aligned with, and extend along, the lead frame plane 188. The first ground contact fingers 164 are interspersed between each of the signal contacts 122.

The shield tails 216 extend into the slots 218 of the body 160. The shield tails 216 may be aligned with, and extend along, the lead frame plane 188. The shield tails 216 are interspersed between each of the mounting portions 184 of the signal contacts 122.

Figure 8:
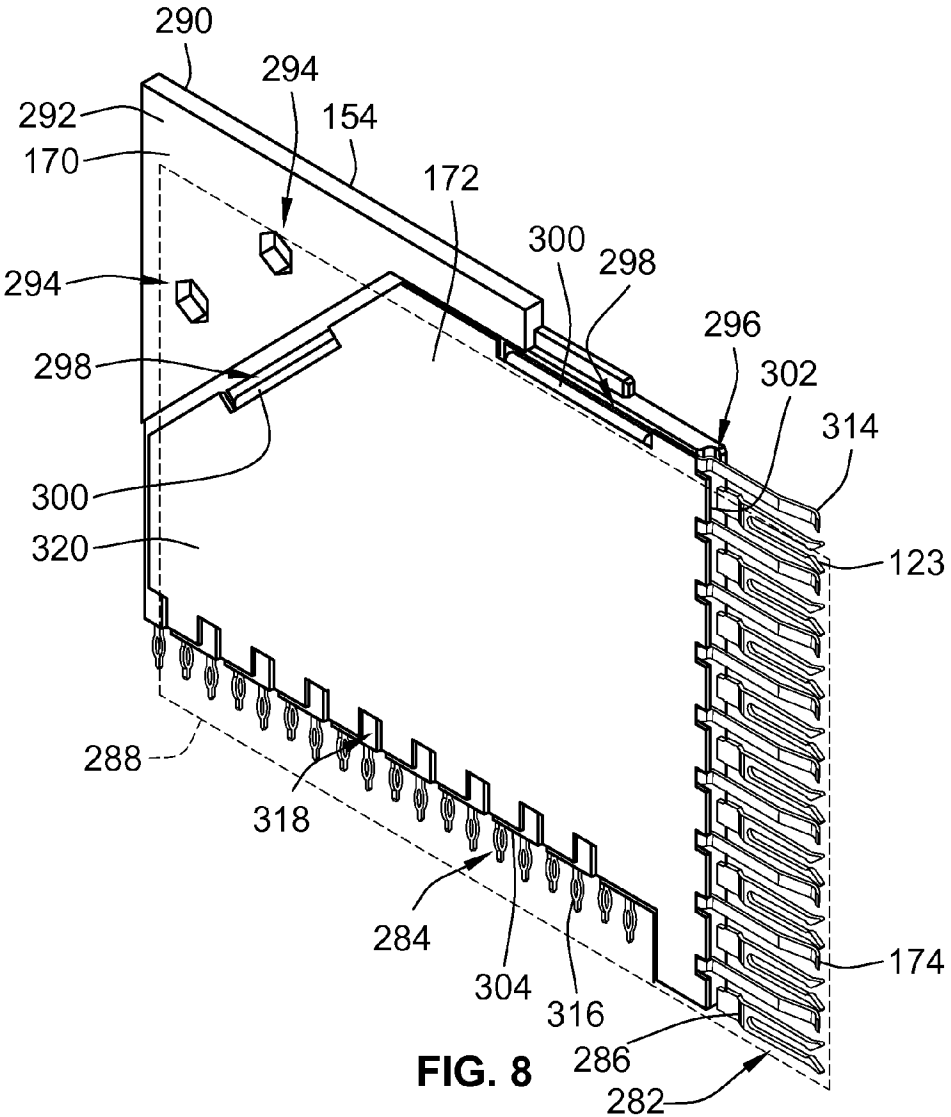
FIG. 8 is a front perspective view of a second chicklet forming part of the contact module shown in FIG. 4.

FIG. 8 is a front perspective view of the second chicklet 154 forming part of the contact module 120 (shown in FIG. 4). The second chicklet 154 represents an overmolded lead frame type of structure. The body 170 is formed by the dielectric material of the overmold, which encases a lead frame (not shown) similar to the lead frame 180 (shown in FIG. 5). The lead frame includes metal conductors that define the signal contacts 123. The second signal contacts 123 cooperate with corresponding first signal contacts 122 of the first chicklet 152 (shown in FIG. 4) to carry differential pair signals with such corresponding first signal contacts 122.

Each signal contact 123 has a mating portion 282 and a mounting portion 284 that are both exposed beyond edges of the body 170. In the illustrated embodiment, the mounting portion 284 constitutes an eye of the needle type contact that is configured to be received within a via of the circuit board. The mating portion 282 extends forwardly from a front end of the body 170. In the illustrated embodiment, the mating portion 282 constitutes a tuning fork style of contact that is configured to receive and mate with the blade type of signal contact 136 (shown in FIG. 1) of the header connector 104. Other types of contacts may be used in alternative embodiments. In an exemplary embodiment, the mating portion 282 includes a jogged section 286. The signal contacts 123 are generally coplanar with one another along a lead frame plane 288. The lead frame plane 288 may be substantially centered within the body 170. The jogged section 286 may transition the mating portion 282 out of the lead frame plane 288.

The body 170 has opposed inner and outer sides 290, 292. The inner and outer sides 290, 292 are generally parallel to the lead frame plane 288. The signal contacts 123 may be generally centered between the inner and outer sides 290, 292. Optionally, the inner side 290 may be planar. The outer side 292 may include a recess that receives the second ground shield 172. In an exemplary embodiment, the body 170 includes securing features 294 for securing the first chicklet 152 together with second chicklet 154. In the illustrated embodiment, the securing features 294 are represented by openings, and may be referred to hereinafter as openings 294. The openings 294 are hexagon shaped to provide an interference fit with the securing features 194 (shown in FIG. 5), however other shapes are possible. Other types of securing features may be used in alternative embodiments, such as a pin, a peg, a fastener, a latch, and adhesive, and the like. Any number of securing features 294 may be used. More than one type of securing features 294 may be provided. In an exemplary embodiment, the body 170 includes grooves 296 at the corner of the front edge and outer side 292 that are configured to receive portions of the second ground shield 172.

The second ground shield 172 is coupled to the outer side 292 of the body 170. The body 170 includes slots 298. The ground shield 172 includes second grounding tabs 300 extending inward therefrom. The second grounding tabs 300 are configured to be received in the slots 298.

The second ground shield 172 includes a forward mating edge 302 and a bottom mounting edge 304 that is perpendicular to the mating edge 302. In an exemplary embodiment, the second ground shield 172 includes the second ground contact fingers 174 that extend forward from the mating edge 302. The second ground contact fingers 174 may extend inward from the inner side 290. The second ground contact fingers 174 are arranged along the mating edge 302 in a predetermined pattern and are aligned with the grooves 296. The second ground contact fingers 174 represent spring fingers that are deflectable. A mating interface 314 is positioned proximate to a distal end of the second ground contact fingers 174. The mating interface 314 is configured for mating with the ground contact 138 (shown in FIG. 1).

The ground shield 172 includes shield tails 316 that extend downward and inward from the mounting edge 304. The shield tails 316 may include one or more eye-of-the-needle type contacts that fit into vias in the circuit board. Other types of contacts may be used for through hole mounting or surface mounting to the circuit board. The bulk of each shield tail 316 is positioned inward with respect to the ground shield 172, which is generally towards the contact module 120 when the ground shield 162 is coupled to the contact module 120. The shield tails 316 are configured to fit in slots 318 formed in the body 170. The shield tails 316 may be stamped from a ground plate 320 defining the ground shield 172 and then bent inward with respect to the ground plate 320. The shield tails 316 are electrically commoned with one another by the ground plate 320. Similarly, the second ground contact fingers 174 are electrically commoned with one another by the ground plate 320.

When assembled, the ground shield 172 is coupled to the outer side 292 of the body 170. The second grounding tabs 300 are received in the slots 298. Optionally, the second grounding tabs 300 may extend beyond the inner side 290 such that the second grounding tabs 300 engage the first chicklet 152. The second ground contact fingers 174 are interspersed between each of the signal contacts 123. The shield tails 316 extend into the slots 318 of the body 160. The shield tails 316 may be aligned with, and extend along, the lead frame plane 288. The shield tails 316 are interspersed between each of the mounting portions 284 of the signal contacts 123.

Figure 9:
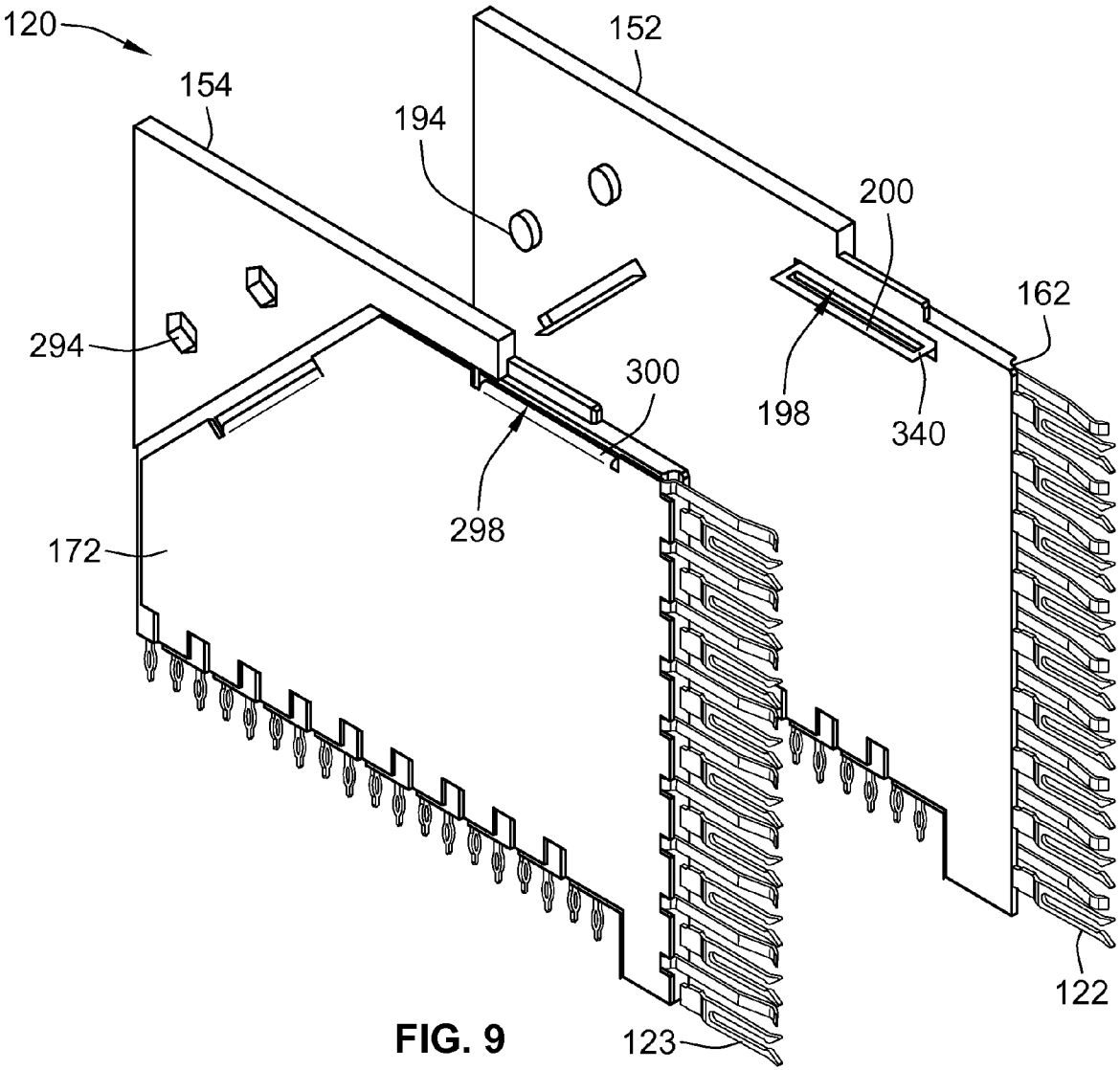
FIG. 9 illustrates the second chicklet shown in FIG. 8 being coupled to the first chicklet shown in FIG. 5.

FIG. 9 illustrates the second chicklet 154 being coupled to the first chicklet 152. The first and second chicklets 152, 154 are aligned with one another and mated together to form the contact module 120. When mated, the pegs 194 are received in the openings 294. The pegs 194 may be held by an interference fit within the openings 294 to securely hold the first and second chicklets 152, 154 together.

When mated, the first grounding tabs 200 are received within the slots 298 of the second chicklet 154. For example, the slots 298 may be wide enough to accommodate both grounding tabs 200, 300. The first grounding tabs 200 include barbs 340 that engage the slots 298 to secure the first and second chicklets 152, 154 together. The first grounding tabs 200 engage the second grounding tabs 300 within the slots 298 to electrically common the first and second ground shields 162, 172. Similarly, when mated, the second grounding tabs 300 are received within the slots 198 of the first chicklet 152. For example, the slots 198 may be wide enough to accommodate both grounding tabs 200, 300. The second grounding tabs 300 include barbs (not shown), which may be similar to the barbs 340, that engage the slots 198 to secure the first and second chicklets 152, 154 together. The second grounding tabs 300 engage the first grounding tabs 200 within the slots 198 to electrically common the first and second ground shields 162, 172.

Referring back to FIG. 4, the contact module 120 is illustrated in the assembled state with the first and second chicklets 152, 154 coupled together. The signal contacts 122, 123 of both the first and second chicklets 152, 154 are vertically aligned directly across from one another on either side of the contact module plane 156. The first and second ground contact fingers 164, 174 are also vertically aligned directly across from one another on either side of the contact module plane 156. The signal contacts 122, 123 receive a corresponding signal contact 136 (shown in FIG. 1) of the header connector 104 (shown in FIG. 1). The first and second ground contact fingers 164, 174 cooperate to both engage the same ground contact 138 (shown in FIG. 1) of the header connector 104.

Figure 10:
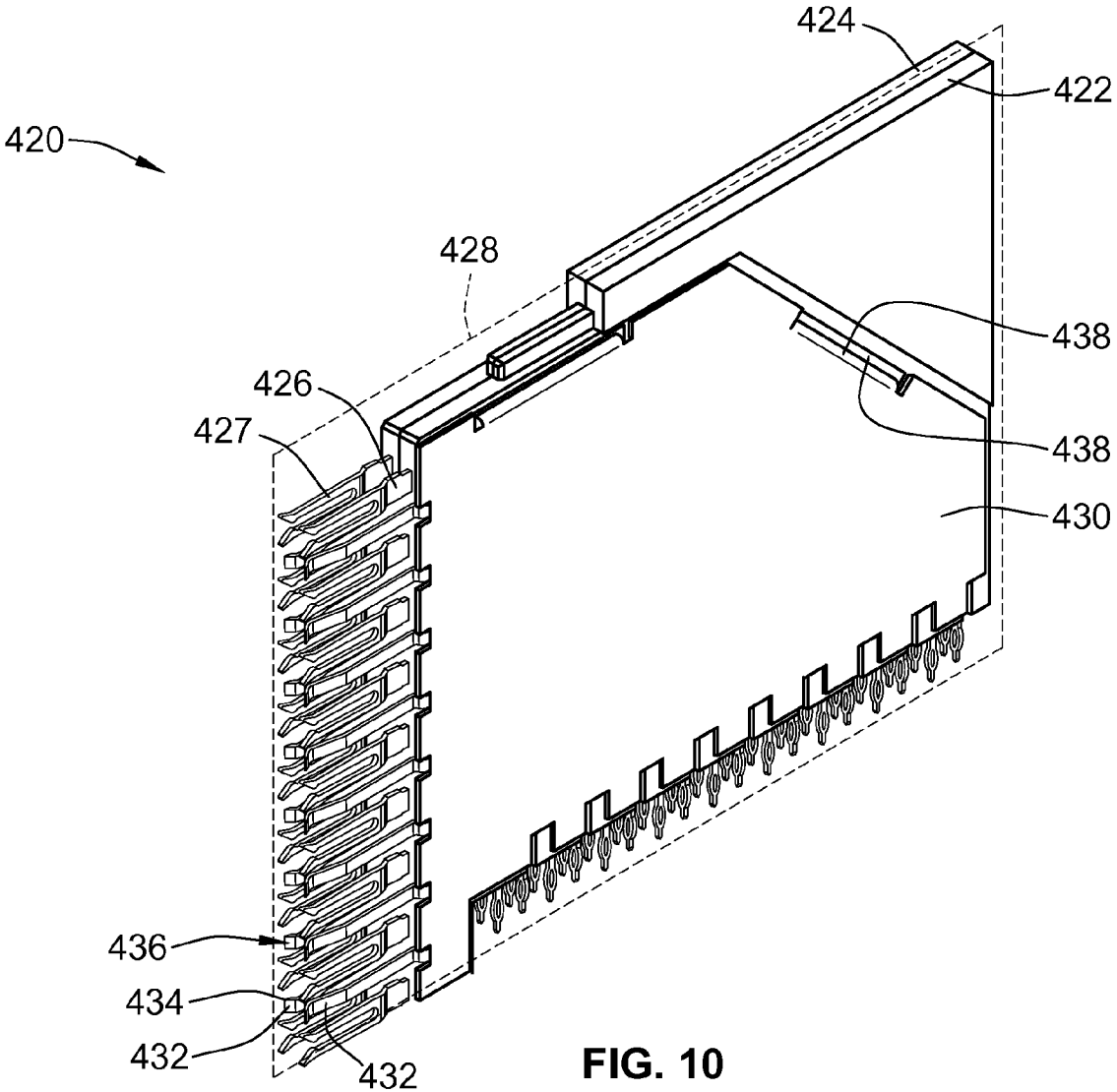
FIG. 10 is a front perspective view of an alternative contact module for the receptacle connector shown in FIG. 1.

FIG. 10 is a front perspective view of an alternative contact module 420 for the receptacle connector 102 (shown in FIG. 1). The contact module 420 is substantially similar to the contact module 120, however the contact module 420 has a different arrangement of signal and ground contacts.

The contact module 420 includes first and second chicklets 422, 424. The first and second chicklets 422, 424 both have signal contacts 426, 427, respectively, that are arranged as differential pairs, with one of the signal contacts 426, 427 of each differential pair being held by the first chicklet 422, and with the other of the signal contacts 426, 427 of each differential pair being held by the second chicklet 424. A contact module plane 428 is defined along the line of intersection between the first and second chicklets 422, 424. The first and second signal contacts 426, 427 are disposed on respective opposite sides of the contact module plane 428 to define the differential pair. As such, neither the first chicklet 422 nor the second chicklet 424 holds signal contacts 426, 427 that carry differential pair signals within a single chicklet 422, 424. Rather, each of the signal contacts 426 in the first chicklet 422 cooperates with a corresponding signal contact 427 in the second chicklet 424 to form a differential pair that carries differential signals.

Each of the first and second chicklets 422, 424 has a ground shield 430. The ground shields 430 have first and second ground contact fingers 432, 434 that are aligned directly across from one another on either side of the contact module plane 428. The aligned first and second ground contact fingers 432, 434 cooperate to define a ground contact 436 that mates with one of the ground contacts 138 (shown in FIG. 1). The ground shields 430 are electrically commoned by grounding tabs 438 that extend through the bodies of the chicklets 422, 424. The ground shields 430 are also electrically commoned when mated with the header connector 104 by the first and second ground contact fingers 432, 434 engaging the same ground contacts 138.

The ground contacts 436 are interspersed between each of the differential pairs of signal contacts 426, 427. The pattern of ground contacts 436 and signal contacts 426, 427 differs from the pattern of ground contacts 140 and signal contacts 122 (shown in FIG. 4). For example, with the contact module 420, the signal contacts 426, 427 are at an upper-most position along the front edge, followed by a ground contact 436, then signal contacts 426, 427 and so on vertically down the front edge. Alternatively, the contact module 120 (shown in FIG. 4) has the opposite pattern, beginning with the ground contact 140 at the uppermost position, followed by the signal contacts 122, and so on.

Referring back to FIG. 1, when the contact modules 120, 420 are loaded into the housing 112, the pattern of signal and ground contacts may be altered by alternating the contact modules 120, 420. As such, the vertical position of the signal contacts may be changed in adjacent rows by sandwiching the contact modules 120 between two of the contact modules 420, and vice versa. The contact modules 120, 420 are loaded into the housing 112 in an assembled state with the first and second chicklets 152, 154 coupled together prior to loading the contact modules 120 into the housing 112 and with the first and second chicklets 422, 424 coupled together prior to loading the contact modules 420 into the housing 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a housing;

contact modules held in the housing, the contact modules having a first chicklet and a second chicklet coupled together to form a corresponding one of the contact modules; and contacts held in the contact modules and arranged in differential pairs, a first contact in the differential pairs being held by the first chicklet, a second contact in the differential pairs being held by the second chicklet.

2. The electrical connector of claim 1, wherein the contacts extend along a contact path between a mating portion at one end and a mounting portion at an opposite end thereof, the contact paths of the first and second contacts within a given differential pair being aligned with one another such that the contact paths of the first and second contacts in the differential pair have the same length.

3. The electrical connector of claim 1, wherein the contact modules have a mating face, the contacts being arranged in columns along the mating face, the first and second contacts of each differential pair being arranged in rows perpendicular to the columns.

4. The electrical connector of claim 1, wherein the contact modules have a mating face, the first contacts being arranged in first columns and the second contacts being arranged in second columns, the first and second contacts of each differential pair being aligned with one another in rows perpendicular to the columns.

5. The electrical connector of claim 1, wherein the first chicklet has a first body overmolded over the first contacts, the second chicklet has a second body overmolded over the second contacts.

6. The electrical connector of claim 1, further comprising first ground contact fingers interspersed between the first contacts and second ground contact fingers interspersed between the second contacts, the first ground contact fingers are aligned with corresponding second ground contact fingers such that the first and second ground contact fingers cooperate to engage a corresponding ground contact of a mating connector.

7. The electrical connector of claim 1, further comprising a ground shield coupled to the first chicklet, the ground shield having a ground plate and a plurality of ground contact fingers extending therefrom, the ground contact fingers being electrically common with the ground plate, the ground contact fingers being interspersed between the first contacts.

8. The electrical connector of claim 1, further comprising:

a first ground shield coupled to the first chicklet, the first ground shield having a plurality of first ground contact fingers and a first grounding tab extending therefrom; and a second ground shield coupled to the second chicklet, the second ground shield having a plurality of second ground contact fingers and a second grounding tab extending therefrom, wherein the first and second grounding tabs engage one another when the first and second chicklets are coupled together to electrically join the first and second ground shields.

9. The electrical connector of claim 1, wherein the first chicklet has a first body having opposed inner and outer sides, the inner side of the first chicklet being flat, the contacts of the first chicklet being encased within the first body and extending parallel to the inner and outer sides of the first chicklet, the second chicklet having a second body with opposed inner and outer sides, the inner side of the second chicklet being flat, the contacts of the second chicklet being encased within the second body and extending parallel to the inner and outer sides of the second chicklet, the inner side of the first body abutting against the inner side of the second body when the first and second chicklets are coupled together.

10. The electrical connector of claim 1, wherein the first and second chicklets include a lead frame defining the contacts and include an overmold defining a dielectric body encasing the contacts.

11. The electrical connector of claim 1, wherein the first and second chicklets are coupled together prior to being loaded into the housing.

12. An electrical connector comprising:

contact modules each having a first chicklet and a second chicklet separate and distinct from one another, the first chicklet having a first body holding first contacts, the second chicklet having a second body holding second contacts, the first body and the second body being coupled together along a contact module plane, the first contacts and the second contacts being arranged in differential pairs with the first contacts and the second contacts being disposed on respective opposite sides of the contact module plane to define the differential pair; and a housing holding the contact modules such that the contact module planes are parallel to one another.

13. The electrical connector of claim 12, wherein the first contacts and the second contacts of each differential pair are arranged in rows perpendicular to the contact module plane.

14. The electrical connector of claim 12, wherein the first chicklet has first ground contact fingers interspersed between the first contacts, the second chicklet has second ground contact fingers interspersed between the second contacts, the first ground contact fingers being aligned with corresponding second ground contact fingers on opposite sides of the contact module plane to form a ground contact set, each ground contact set being configured to engage a corresponding ground contact of a mating connector.

15. The electrical connector of claim 12, further comprising:

a first ground shield coupled to the first chicklet, the first ground shield having a plurality of first ground contact fingers and a first grounding tab extending therefrom; and a second ground shield coupled to the second chicklet, the second ground shield having a plurality of second ground contact fingers and a second grounding tab extending therefrom, wherein the first and second grounding tabs engage one another when the first and second chicklets are coupled together to electrically join the first and second ground shields.

16. The electrical connector of claim 12, wherein the first body has opposed inner and outer sides, the inner side of the first body being flat, the first contacts being encased within the first body and extending parallel to the inner and outer sides of the first body, the second body having opposed inner and outer sides, the inner side of the second body being flat, the second contacts being encased within the second body and extending parallel to the inner and outer sides of the second body, the inner side of the first body abutting against the inner side of the second body when the first and second chicklets are coupled together.

17. An electrical connector comprising:

a housing holding a plurality of contact modules, the contact modules comprising:

a first chicklet having a first body holding first contacts, the first chicklet having first ground contact fingers being electrically grounded; and a second chicklet having a second body holding second contacts, the second chicklet having second ground contact fingers being electrically grounded, the second chicklet being separate and distinct from the first chicklet, the second chicklet being coupled to the first chicklet to form the contact module;

wherein the contact modules have the first and second contacts arranged in differential pairs with one of the contacts of the differential pair being one of the first contacts and the other of the contacts of the differential pair being one of the second contacts.

18. The electrical connector of claim 17, wherein the first body includes a peg and the second body includes an opening that receives the peg when the first and second chicklets are coupled together, the first and second chicklets being coupled together prior to being loaded into the housing.

19. The electrical connector of claim 17, wherein the first ground contact fingers are interspersed between adjacent first contacts along a first column and the second ground contact fingers are interspersed between adjacent second contacts along a second column, and wherein within each differential pair the corresponding first and second contacts are aligned in a row perpendicular to the first and second columns.

20. The electrical connector of claim 17, wherein the first body and the second body are coupled together along a contact module plane, the first ground contact fingers are aligned with corresponding second ground contact fingers on opposite sides of the contact module plane to form a ground contact set, each ground contact set being configured to engage a corresponding ground contact of a mating connector.

* * * * *